US010237923B2

(12) United States Patent
Park

(10) Patent No.: US 10,237,923 B2
(45) Date of Patent: Mar. 19, 2019

(54) TRANSPARENT FILM HEATER AND MANUFACTURING METHOD THEREOF

(71) Applicant: INDUSTRY-ACADEMIC COOPERATION FOUNDATION, YONSEI UNIVERSITY, Seoul (KR)

(72) Inventor: Jin-Woo Park, Seoul (KR)

(73) Assignee: INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 626 days.

(21) Appl. No.: 14/931,309

(22) Filed: Nov. 3, 2015

(65) Prior Publication Data

US 2016/0198527 A1 Jul. 7, 2016

(30) Foreign Application Priority Data

Jan. 6, 2015 (KR) ..... 10-2015-0001310

(51) Int. Cl.

| | |
|---|---|
| ***H05B 3/12*** | (2006.01) |
| ***H05B 3/18*** | (2006.01) |
| ***H05B 3/84*** | (2006.01) |
| ***H05B 3/14*** | (2006.01) |

(52) U.S. Cl.

CPC ..... *H05B 3/84* (2013.01); *H05B 3/145* (2013.01); *H05B 2203/011* (2013.01); *H05B 2203/014* (2013.01); *H05B 2214/04* (2013.01)

(58) Field of Classification Search

None

See application file for complete search history.

(56) References Cited

U.S. PATENT DOCUMENTS

2004/0188418 A1* 9/2004 Aisenbrey ..... B29C 45/0013 219/528
2012/0193341 A1* 8/2012 Reul ..... H05B 3/84 219/203
2012/0196114 A1* 8/2012 Hsu ..... H01B 1/22 428/301.1
2013/0206227 A1* 8/2013 Shimizu ..... H01G 9/2022 136/256
2013/0341074 A1* 12/2013 Virkar ..... B82Y 30/00 174/255
2013/0342221 A1* 12/2013 Virkar ..... G06F 3/041 324/661

(Continued)

FOREIGN PATENT DOCUMENTS

KR 100797094000 1/2008
KR 10-2009-0109807 10/2009

(Continued)

OTHER PUBLICATIONS

KR 10-2014-0195094, Lee et al, Dec. 2014, English translation of priority doc for US PGPub. 2017/0353996.*

*Primary Examiner* — Joseph M Pelham
(74) *Attorney, Agent, or Firm* — Duane Morris LLP; J. Rodman Steele, Jr.; Gregory M. Lefkowitz

(57) ABSTRACT

Provided is a transparent film heater including: a transparent substrate 100; and a heat-emitting layer 200 that includes conductive nanowires 10 forming a network, and a coating material 20 applied to the nanowires 10 and functioning to bind the nanowires 10 with each other, is disposed on the transparent substrate 100, and emits heat upon the application of a voltage.

13 Claims, 6 Drawing Sheets

(56) References Cited

U.S. PATENT DOCUMENTS

| | | | | |
|---|---|---|---|---|
| 2014/0332254 | A1* | 11/2014 | Pellerite | G02F 1/13439 174/251 |
| 2015/0114952 | A1* | 4/2015 | Tai | H05B 3/84 219/549 |
| 2015/0327334 | A1* | 11/2015 | Choi | H05B 3/84 219/203 |
| 2016/0133349 | A1* | 5/2016 | Cho | B82Y 10/00 428/196 |
| 2016/0162063 | A1* | 6/2016 | Lovenich | H05K 9/0096 428/209 |
| 2016/0198571 | A1* | 7/2016 | Park | H05K 1/092 174/251 |
| 2017/0094723 | A1* | 3/2017 | Kim | B22F 1/0025 |
| 2017/0118800 | A1* | 4/2017 | Baba | H05B 3/20 |
| 2017/0282414 | A1* | 10/2017 | Liou | B32B 7/12 |
| 2017/0353996 | A1* | 12/2017 | Lee | H05B 3/84 |
| 2018/0014359 | A1* | 1/2018 | Simonato | H05B 3/146 |
| 2018/0070411 | A1* | 3/2018 | Wei | H05B 3/84 |

FOREIGN PATENT DOCUMENTS

| | | | |
|---|---|---|---|
| KR | 10-1465518 | | 11/2014 |
| KR | 1020140195094 | * | 12/2014 |

* cited by examiner

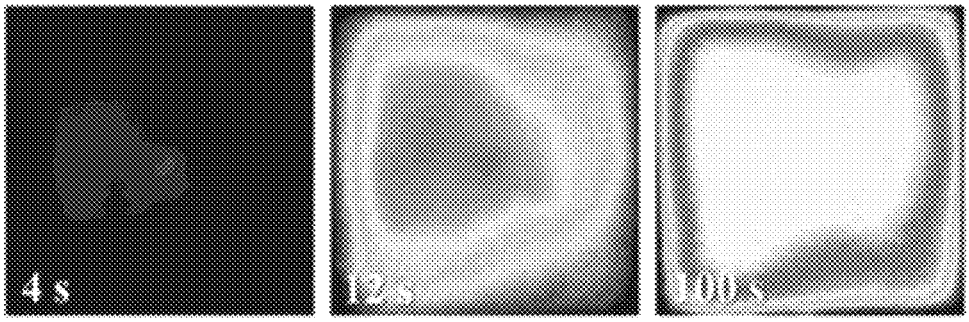
FIG. 6(a)
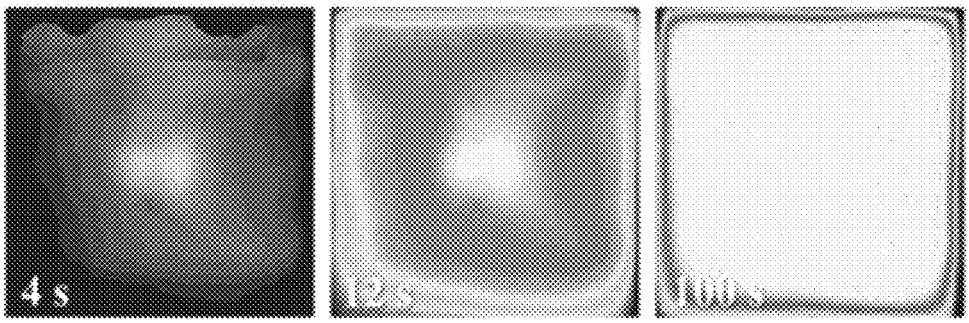
FIG. 6(b)
FIG. 7
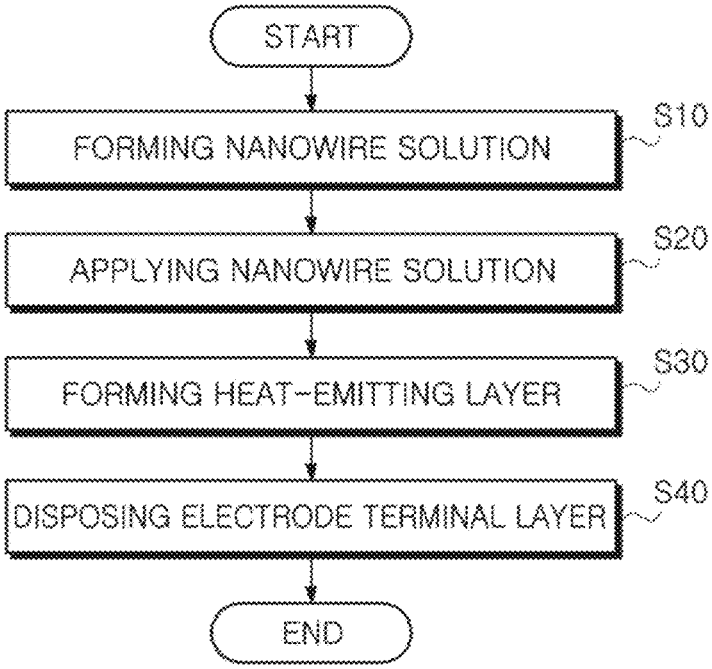

TRANSPARENT FILM HEATER AND MANUFACTURING METHOD THEREOF

CROSS-REFERENCE TO RELATED APPLICATIONS

This application claims priority under 35 U.S.C. § 119 to Korean Patent Application No. 10-2015-0001310 filed on Jan. 6, 2015, in the Korean Intellectual Property Office, the disclosure of which is incorporated herein by reference in its entirety.

TECHNICAL FIELD

The following disclosure relates to a transparent film heater and a method for manufacturing the same.

BACKGROUND

Recently, transparent conductive thin films have been used for various electronic devices, such as organic light emitting diodes, displays, solar cells, or the like. Such transparent conductive thin films are used mostly as electrodes to make an electrical connection in many electronic devices. Transparent conductive electrodes (TCEs) using transparent conductive thin films are applied to transparent film heaters (TFHs) based on the Joule heating. Such transparent film heaters are used in aircraft displays, liquid crystal display (LCD) panels, car window defrosters, or the like. A conductive oxide used largely in transparent film heaters is indium tin oxide (ITO) having excellent conductivity and transparency. However, indium tin oxide (ITO) has brittleness in nature, and thus is limited in applications to flexible electronic devices. In addition, scarcity of indium materials is a cause of an increase in manufacturing cost for transparent film heaters.

To solve the above-mentioned problems of indium tin oxide (ITO), transparent film heaters using carbon nanotubes (CNTs) have been suggested as disclosed in the following patent document. However, although carbon nanotubes (CNTs) may substitute for indium tin oxide (ITO) in terms of mechanical flexibility and thermal response, they have a large sheet resistance and require a high driving voltage.

Therefore, there is an imminent need for a solution for the above-mentioned problems occurring in the conventional transparent film heaters.

REFERENCES

Patent Document

Patent Document 1: KR10-0790094 B1

SUMMARY

To solve the above-mentioned problems, an embodiment of the present disclosure is directed to providing a transparent film heater that includes a heat-emitting layer including conductive nanowires and disposed on a transparent substrate, has excellent flexibility, and is capable of high-speed heating even at a low driving voltage.

Another embodiment of the present disclosure is directed to providing a transparent film heater that includes nanowires coated with a coating material, shows an increased average temperature and maximum temperature, and maintains a uniform temperature over the whole area of a transparent substrate.

In one aspect, there is provided a transparent film heater including: a transparent substrate; and a heat-emitting layer that includes conductive nanowires emitting heat upon the application of a voltage and forming a network, and a coating material applied to the nanowires and functioning to bind the nanowires with each other, and is disposed on the transparent substrate.

According to an embodiment, the transparent substrate has flexibility.

According to another embodiment, the transparent substrate is a substrate having a light transmission of at least 80%.

According to still another embodiment, the nanowires are silver (Ag) nanowires.

According to still another embodiment, the coating material is indium tin oxide (ITO) or aluminum zinc oxide (AZO).

According to still another embodiment, the transparent film heater includes an electrode terminal layer disposed at either side edge of the heat-emitting layer.

According to yet another embodiment, the transparent substrate is disposed on a display panel, penscope, defroster or goggle.

In another aspect, there is provided a method for manufacturing a transparent film heater, including the steps of: (A) mixing conductive nanowires emitting heat upon the application of a voltage and forming a network with a solvent to provide a nanowire solution; (B) applying the nanowire solution to a transparent substrate; and (C) applying a coating material to the nanowires applied to the transparent substrate to form a heat-emitting layer.

According to an embodiment, the transparent substrate has flexibility.

According to another embodiment, the transparent substrate is a substrate having a light transmission of at least 80%.

According to still another embodiment, the nanowires are silver (Ag) nanowires.

According to still another embodiment, the coating material is indium tin oxide (ITO) or aluminum zinc oxide (AZO).

According to still another embodiment, the method further includes a step of additionally applying the nanowire solution at least once, after the step of applying the nanowires.

According to still another embodiment, in the step of additionally applying the nanowire solution, the nanowire solution is applied through spin coating.

According to still another embodiment, the method further includes, after the step of additionally applying the nanowire solution, a step of heat treating the additionally applied nanowire solution.

According to yet another embodiment, the method further includes a step of disposing an electrode terminal layer for applying a voltage at either side of the heat-emitting layer, after the step of forming the heat-emitting layer.

The above and other aspects, features and advantages of the disclosed exemplary embodiments will be more apparent from the following detailed description taken in conjunction with the accompanying drawings.

It will be understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

According to the transparent film heater disclosed herein, a heat-emitting layer including conductive nanowires is disposed on a transparent substrate. Since the nanowires have a low sheet resistance and high transmission, the transparent film heater disclosed herein has excellent flexibility and is capable of high-speed heating even at a low driving voltage.

In addition, a coating material is applied to the nanowires so that the nanowires are bound to each other effectively and the heat-emitting layer is thermally insulated. Thus, the transparent film heater has an increased average temperature and maximum temperature and maintains a uniform temperature over the whole area of the transparent substrate.

BRIEF DESCRIPTION OF THE DRAWINGS

FIG. 6*a* is an image showing the temperature distribution disparity of the first transparent film.

FIG. 6*b* is an image showing the temperature distribution uniformity of the third transparent film heater.

FIG. 7 is a flow chart Illustrating the method for manufacturing a transparent film heater according to an embodiment.

DETAILED DESCRIPTION OF EMBODIMENTS

Figure 1:
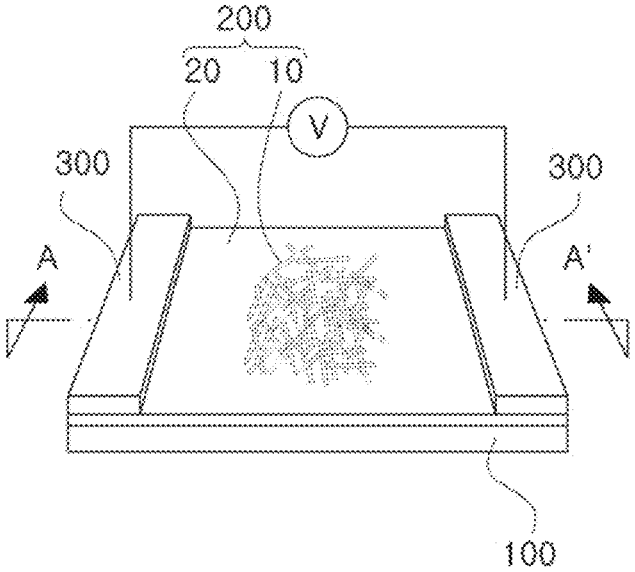
FIG. 1 is a perspective view illustrating the transparent film heater according to an embodiment.

The advantages, features and aspects of the present disclosure will become apparent from the following description of the embodiments with reference to the accompanying drawings, which is set forth hereinafter. In the drawings, like reference numerals denote like elements. Moreover, the use of the terms first, second, etc. does not denote any order or importance, but rather the terms 'first', 'second', etc. are used to distinguish one element from another. In the description, details of well-known features and techniques may be omitted to avoid unnecessarily obscuring the presented embodiments.

Hereinafter, preferred embodiments of the present disclosure will be explained in detail with reference to the accompanying drawings.

Figure 2:
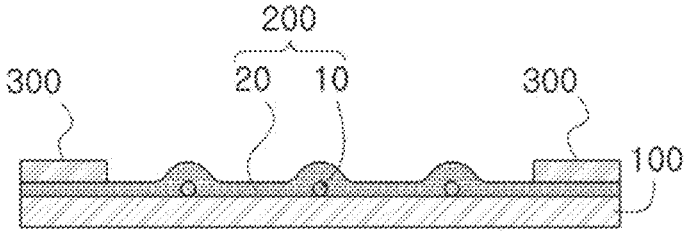
FIG. 2 is a sectional view of FIG. 1 taken along line A-A'.

FIG. 1 is a perspective view illustrating the transparent film heater according to an embodiment. FIG. 2 is a sectional view of FIG. 1 taken along line A-A', As shown in FIG. 1 and FIG. 2, the transparent film heater according to an embodiment includes a transparent substrate 100, and a heat-emitting layer 200 that includes conductive nanowires 10 emitting heat upon the application of a voltage and forming a network, and a coating material 20 applied to the nanowires 10 and functioning to bind the nanowires 10 with each other, and is disposed on the transparent substrate 100.

The transparent film heater disclosed herein is a thin film heater using transparent conductive electrodes (TCEs) emitting heat by thermal resistance heating (Joule heating), and Includes a transparent substrate 100 and a heat-emitting layer 200.

The transparent film heater disclosed herein uses transparent conductive electrodes as heaters. In other words, the transparent film heater disclosed herein is a heater using the Joule heat generated when electric current passes through the transparent conductive thin film.

Meanwhile, the transparent film heater disclosed herein has a light transmission of at least 80%, and thus is very transparent. Therefore, the transparent film heater disclosed herein may be applied to various instruments requiring transparency, such as display panels, periscopes, car window defrosters or goggles.

To ensure such conductivity and transparency, the transparent film heater disclosed herein is obtained by coating a transparent substrate 100 with a transparent heat-emitting layer 200.

Herein, the transparent substrate 100 may include any one selected from glass, polymers and frit glass. Particularly, the transparent substrate 100 has a light transmission of at least 80%. Meanwhile, the transparent film heater disclosed herein may be applied to flexible instruments. In this case, the transparent substrate 100 having flexibility may be formed of polyethylene terephthalate (PET), polyethylene naphthalate (PEN), polyimide (PI), polydimethylsiloxane (PDMS), polyurethane, or the like. However, the transparent substrate 100 is not limited to the above-listed polymers but includes any known polymer that may be used for transparent flexible instruments. When the transparent substrate is disposed in an instrument or device, such as a display panel, periscope, defroster or goggle, it transfers heat generated from the heat-emitting layer 200.

Meanwhile, the heat-emitting layer 200 is a thin film layer disposed on the transparent 100 so that it may emit heat upon the application of a voltage, and includes conductive nanowires 10 and a coating material 20.

Herein, the nanowires 10 are those having a fine size and forming a network, have high transparency and conductivity, and thus emit heat by the Joule heating upon the application of a voltage. Such conductive nanowires include any metallic nanowires, such as silver (Ag) or copper, and silver (Ag) nanowires (AgNW) being most preferred in terms of conductivity, flexibility and transparency. Particularly, silver nanowires have a low sheet resistance, and thus enable high-speed heating at a low driving voltage and show high flexibility. In addition, a network of silver nanowires has a transparency up to 80-90%. Herein, silver nanowires may have a diameter of 30-40 nm and a length of 20-40 μm. Hereinafter, the nanowires 10 are exemplified by silver nanowires but are not limited thereto. Silver nanowires are conductive materials substituting for indium tin oxide (ITO) and carbon nanotubes (CNTs) used in the conventional transparent film heaters, and have higher conductivity and flexibility as compared to indium tin oxide (ITO) and carbon nanotubes (CNTs). Such silver nanowires 10 form a network and are disposed on a large-area transparent substrate 100. Herein, a coating material 20 is applied to the silver nanowires 10 to form a heat-emitting layer 200.

The coating material 20 is applied to the silver nanowires 10 and functions to bind the silver nanowires 10 with each other to form a heat-emitting layer 200. Therefore, the heat-emitting layer 200 has the silver nanowires 10 disposed inside a thin film formed of the coating material 20. Although silver nanowires 10 have high conductivity, flexibility and transparency, they have a difficulty in forming a uniform network on the large-area transparent substrate 100 by themselves. To solve the problem of non-uniformity of the network of silver nanowires 10, the density of silver nanowires 10 may be increased. However, in this case, the surface roughness excessively increases in proportion to density, and thus it is not possible to provide an adequate solution. On the contrary, a combination of silver nanowires 10 with a coating material 20 can solve the above-mentioned problem. Particularly, the coating material 20 is attached to the silver nanowires 10 and functions to bind the silver nanowires 10 with each other. In this manner, it is possible to form a uniform network.

The coating material 20 having such a function may be aluminum zinc oxide (AZO). However, the coating material 20 is not limited thereto, and for example, it may include indium tin oxide (ITO) or silver nanoparticles. However, carbon nanotubes (CNTs) or graphene is not suitable, because they require silver nanowires 10 having high density at the initial time in order to form a uniform network of silver nanowires.

Meanwhile, the coating material 20 including aluminum zinc oxide (AZO) may be one that generates heat at high temperature uniformly over the whole area of the transparent substrate 100. Hereinafter, the function of aluminum zinc oxide (AZO) coating material 20 will be explained in detail.

The aluminum zinc oxide (AZO) coating material 20 functions to form a uniform network of silver nanowires 10 but substantially has little effect upon the sheet resistance or transparency of the transparent film heater disclosed herein.

Figure 3:
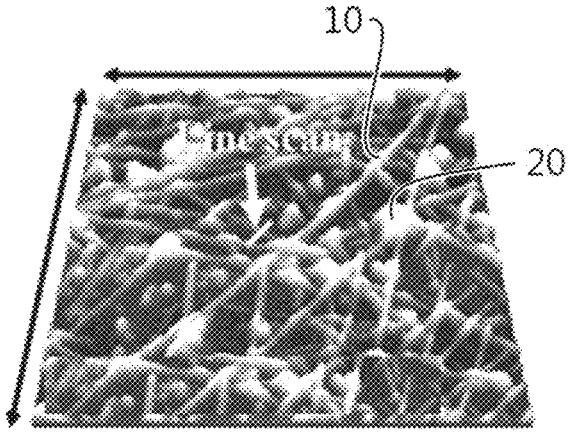
FIG. 3 is an atomic force microscopic (AFM) image illustrating the heat-emitting layer of the transparent film heater according to an embodiment.
Figure 4:
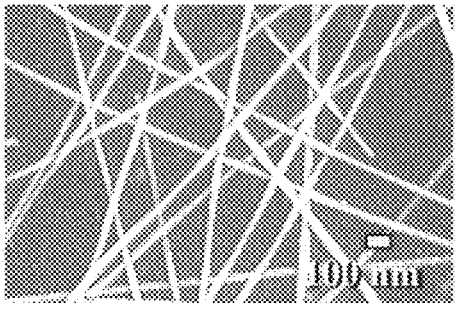
FIG. 4*a* is a field emission scanning electron microscopic (FE-SEM) image of a first transparent film heater using a network of silver nanowires alone as a first heat-emitting layer.
FIG. 4*b* is a FE-SEM image of a second transparent film heater having a second heat-emitting layer including an aluminum zinc oxide (AZO) coating material applied to the network of silver nanowires to a thickness of 15 nm.
FIG. 4*c* is a FE-SEM image of a third transparent film heater having a third heat-emitting layer including an aluminum zinc oxide (AZO) coating material applied to a thickness of 60 nm.
Figure 4:
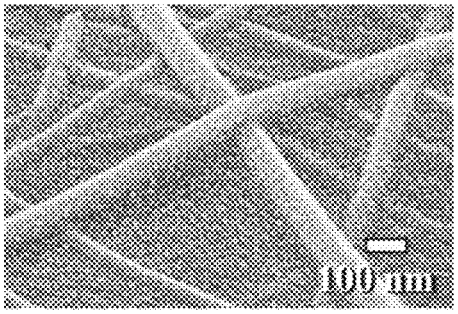
Figure 4:
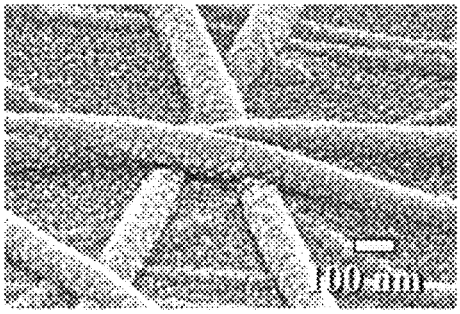

FIG. 3 is an atomic force microscopic (AFM) image illustrating the heat-emitting layer of the transparent film heater according to an embodiment. FIGS. 4*a*, 4*b* and 4*c* are field emission scanning electron microscopic (FE-SEM) images illustrating the heat-emitting layer of the transparent film heater according to an embodiment.

As shown in FIG. 3, the aluminum zinc oxide (AZO) coating material 20 is attached to the silver nanowires 10 and functions to bind the silver nanowires 10 with each other so that a uniform network of silver nanowires may be formed. Herein, aluminum zinc oxide (AZO) may include 98 wt % of zinc oxide (ZnO) and 2 wt % of aluminum oxide ($Al_2O_3$).

In FIGS. 4*a*, 4*b* and 4*c*, while the aluminum zinc oxide (AZO) coating material is applied to the silver nanowires, a field emission scanning electron microscope is used to scan the surface of the transparent film heater. Particularly, FIG. 4*a* shows a first transparent film heater using a network of silver nanowires alone as a first heat-emitting layer. Meanwhile, FIG. 4*b* shows a second transparent film heater having a second heat-emitting layer including an aluminum zinc oxide (AZO) coating material applied to the network of silver nanowires to a thickness of 15 nm. In addition, FIG. 4*c* shows a third transparent film heater having a third heat-emitting layer including an aluminum zinc oxide (AZO) coating material applied to a thickness of 60 nm. Herein, the first, second and the third transparent film heaters are in the same condition and are different from each other in terms of the presence and thickness of a coating material.

The following Table shows the characteristics of the transparent film heaters.

| Samples | Thickness of Coating Material (nm) | Sheet Resistance (Ω/sq.) | Maximum Transparency (%) |
|---|---|---|---|
| First Coating Material | 15 | — | 95.5 |
| Second Coating Material | 60 | | 90.3 |
| First Transparent Film Heater | — | 29.7 | 93.7 |
| Second Transparent Film Heater | — | 31.3 | 91.6 |
| Third Transparent Film Heater | — | 30.0 | 85.6 |

Herein, the first coating material means an aluminum zinc oxide (AZO) coating material having a thickness of 15 nm, and the second coating material means an aluminum zinc oxide (AZO) coating material having a thickness of 60 nm.

As shown in the above Table, the first, second and the third transparent film heaters show little difference in sheet resistance although aluminum zinc oxide (AZO) is applied thereto. As the sheet resistance decreases, the amount of heat emission per unit area of a film heater increases. However, the second and third transparent film heaters have a larger sheet resistance as compared to the first transparent film heater, but the difference between both heaters is not significant. This suggests that aluminum zinc oxide (AZO) has little effect upon the sheet resistance of the transparent film heater disclosed herein.

In addition, although the first, second and the third transparent film heaters have a different transparency, all of them have a transparency of at least 80% and satisfy a transparency required for a transparent film heater. As a result, it can be seen that aluminum zinc oxide (AZO) having high transparency in itself has little effect upon the transparency of the transparent film heater disclosed herein.

Meanwhile, the aluminum zinc oxide (AZO) coating material improves the heat emitting characteristics of the transparent film heater disclosed herein.

Figure 5A:
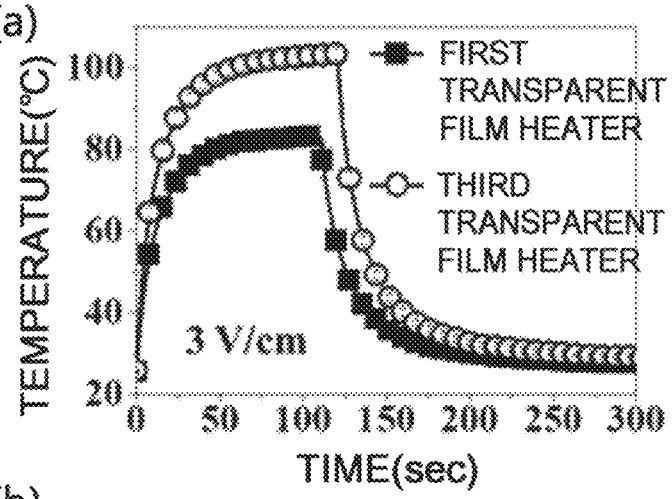
FIG. 5*a* is a graph illustrating temperature of heat emission versus time for the first transparent film heater and the third transparent film heater.
Figure 5B:
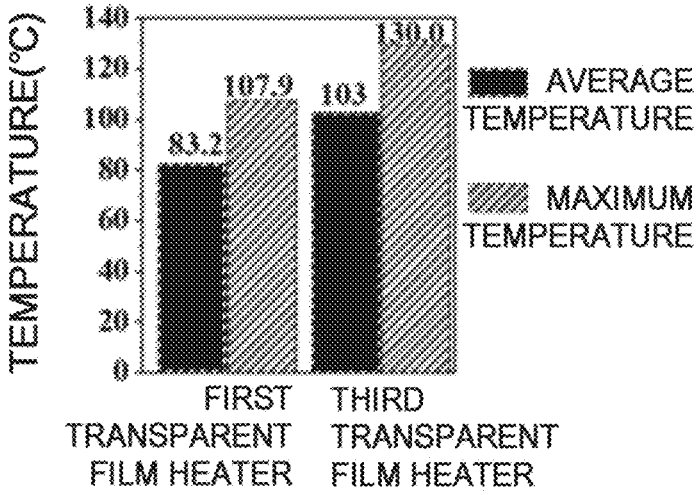
FIG. 5*b* is a graph illustrating the average and maximum temperature of heat emission for the first transparent film heater, and the third transparent film heater.

FIGS. 5*a* and 5*b* are graphs Illustrating the temperature of heat emission of the transparent film heater according to an embodiment as a function of time.

In FIGS. 5*a* and 5*b*, the temperature of heat generated from each of the first transparent film heater and the third transparent film heater is measured. As a result, it can be seen from FIG. 5*a* that the heat generated from each of the first transparent film heater and the third transparent film heater undergoes an increase in temperature with time and is in a stable state at the maximum temperature. It can be also seen from FIG. 5*b* that the third transparent film heater has a higher average temperature and maximum temperature as compared to the first transparent film heater. Therefore, the transparent film heater disclosed herein includes an aluminum zinc oxide (AZO) coating material applied to the silver nanowires, and thus provides an increased average temperature and maximum temperature.

In addition, the aluminum zinc oxide (AZO) coating material provides the transparent film heater disclosed herein with a uniform temperature distribution.

FIGS. 6*a* and 6*b* are images illustrating the temperature distribution of the transparent film heater according to an embodiment, as taken by an infrared camera.

In FIGS. 6*a* and 6*b*, the temperature distribution of each of the first transparent film heater and the third transparent film heater is determined. As a result, it can be seen that the temperature distribution of the third transparent film heater of FIG. 6*b* is more uniform over the whole area, as compared to the temperature distribution of the first transparent film heater of FIG. 6*a*. Therefore, the transparent film heater disclosed herein includes an aluminum zinc oxide (AZO) coating material applied to the silver nanowires, and thus maintains a uniform temperature over the whole area of the transparent substrate.

It is thought that the above-mentioned effects of the transparent film heater disclosed herein result from the heat insulation property of aluminum zinc oxide (AZO). Particularly, since the aluminum zinc oxide (AZO) coating material 20 (see, FIG. 2) surrounds the silver nanowires 10 (see, FIG. 2), it reduces the area of silver nanowires 10 (see, FIG. 2) that is in contact with the external air. In addition, the aluminum zinc oxide (AZO) coating material (see, FIG. 2) has low heat conductivity in itself. Therefore, since the aluminum zinc oxide (AZO) coating material 20 (see, FIG. 2) minimizes the heat transfer from the silver nanowires 10 (see, FIG. 2) to the external air, the transparent film heater disclosed herein has an increased average temperature and maximum temperature of the heat generated therefrom and a uniform temperature distribution.

Meanwhile, the transparent film heater disclosed herein may further include an electrode terminal layer 300 (see, FIG. 1 and FIG. 2) in order to apply a voltage to the silver nanowires 10 (see, FIG. 1 and FIG. 2). Herein, since the electrode terminal layer 300 (see, FIG. 1 and FIG. 2) is disposed at either side edge of the heat emitting layer 200 (see, FIG. 1 and FIG. 2), electric current flows through the heat-emitting layer 200 (see, FIG. 1 and FIG. 2) by the voltage applied through the electrode terminal layer 300, and thus the silver nanowires 10 (see, FIG. 1 and FIG. 2) emit heat.

Hereinafter, the method for manufacturing a transparent film heater according to the present disclosure will be explained.

Figure 8:
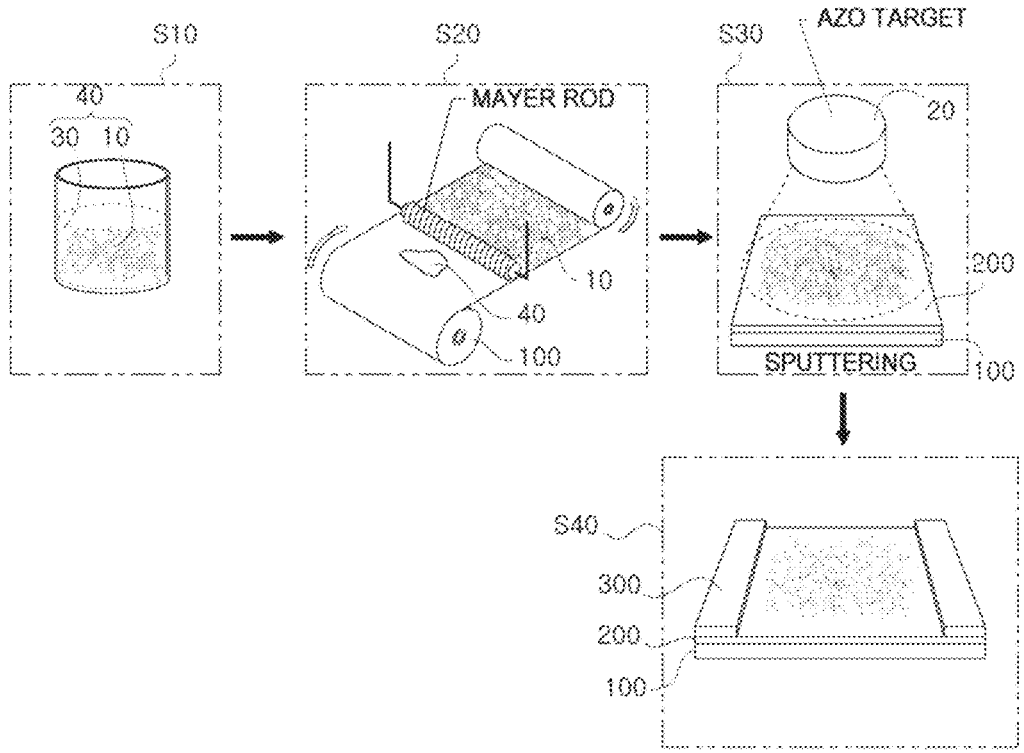
FIG. 8 is a schematic view illustrating the transparent film heater obtained by the method for manufacturing a transparent film heater according to an embodiment.

FIG. 7 is a flow chart illustrating the method for manufacturing a transparent film heater according to an embodiment. FIG. 8 is a schematic view illustrating the transparent film heater obtained by the method for manufacturing a transparent film heater according to an embodiment.

As shown in FIG. 7 and FIG. 8, the method for manufacturing the transparent film heater according to an embodiment includes the steps of: (A) mixing conductive nanowires 10 emitting heat upon the application of a voltage and forming a network with a solvent 30 to provide a nanowire solution 40 (S10); (B) applying the nanowire solution 40 to a transparent substrate 100 (S20); and (C) applying a coating material 20 to the nanowires applied to the transparent substrate 100 to form a heat-emitting layer 200 (S30).

The method for manufacturing a transparent film heater according to the present disclosure includes the steps of: forming a nanowire solution 40 (S10); applying the nanowire solution 40 (S20); and forming a heat-emitting layer 200 (S30).

Herein, the nanowires are exemplified by silver nanowires 10 but are not limited thereto. In addition, the transparent substrate 100 and the coating material 20 are the same as described above, and only a different point will be explained hereinafter.

In step 810 of forming a nanowire solution 40, silver nanowires 10 are mixed with a solvent 30. Herein, the solvent 30 includes any known solvent material, as long as it may be applied to the transparent substrate 100 after mixing with the silver nanowires 10. The solvent is determined particularly by the coating method of the nanowire solution 40.

In step S20 of applying the nanowire solution 40, the silver nanowire solution 40 is applied and coated onto the transparent substrate 100. Such coating may be carried out by Ink-jet, spray coating or bar coating. Particularly, bar coating is carried out by using the Mayer rod. More particularly, the Mayer rod includes a rod-like body on which fine wires are wound, and the transparent substrate 100 moves while being in contact with the Mayer rod in a roll-to-roll mode. Herein, when the silver nanowire solution 40 is sprayed to the transparent substrate 100, the Mayer rod allows spreading and coating of the silver nanowire solution 40. Meanwhile, considering the sheet resistance and transparency, the nanowire solution 40 may be applied to the transparent substrate 100 to a thickness of 110-130 μm, preferably 115-125 μm. However, the coating thickness is not limited thereto. After the nanowire solution 40 is applied, the transparent substrate 100 may be heat treated to remove the solvent 30.

After step S20 of applying the nanowires 10, step S30 of forming a heat-emitting layer 200 is carried out. In step S30 of forming a heat-emitting layer 200, a coating material 20 is applied. When the coating material 20 is aluminum zinc oxide (AZO), sputtering may be carried out by using aluminum zinc oxide (AZO) including 98 wt % of zinc oxide (ZnO) and 2 wt % of aluminum oxide ($Al_2O_3$) as a target. However, applying the coating material is not limited to such a sputtering method.

Meanwhile, the method for manufacturing a transparent film heater according to the present disclosure may further include step S40 of disposing an electrode terminal layer 300. In the step of disposing an electrode terminal layer 300, an electrode terminal layer 300 for applying a voltage is disposed at either side edge of the heat-emitting layer 200.

Figure 9:
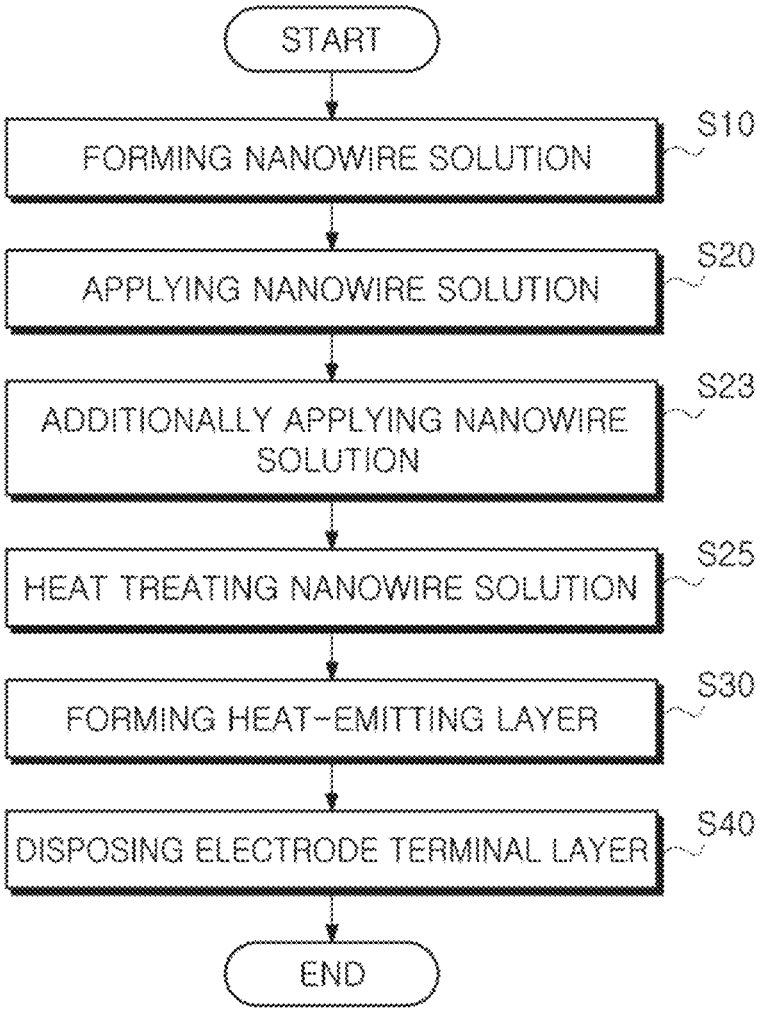
FIG. 9 is a flow chart illustrating the method for manufacturing a transparent film heater according to another embodiment.

FIG. 9 is a flow chart illustrating the method for manufacturing a transparent film heater according to another embodiment.

The method for manufacturing a transparent film heater according to another embodiment of the present disclosure may further include step S23 of additionally applying a nanowire solution 40 (see. FIG. 8). Herein, the step of additionally applying the nanowire solution 40 (see, FIG. 8) is carried out after step S20 of applying the nanowire solution 40 (see, FIG. 8). It is possible to reduce the sheet resistance by additionally applying the nanowire solution 40 (see, FIG. 8) at least once. Herein, applying the nanowire solution 40 (see, FIG. 8) may be carried out by spin coating, but is not limited thereto.

In addition, the method for manufacturing a transparent film heater according to another embodiment of the present disclosure may further include step S25 of heat treating the nanowire solution 40 (see, FIG. 8). The step of heat treating the nanowire solution 40 (see, FIG. 8) is carried out after step S23 of additionally applying the nanowire solution 40 (see, FIG. 8) so that the additionally applied nanowire solution 40 (see, FIG. 8) may be heat treated. Particularly, the nanowire solution 40 additionally applied by the above-mentioned spin coating method is heat treated at 90° C. for 10 minutes. However, the heat treatment condition is not limited thereto and is determined by considering the sheet resistance and transparency.

While the present disclosure has been described with respect to the specific embodiments, it will be apparent to those skilled in the art that various changes and modifications in form and details may be made thereto without departing from the scope of the present disclosure.

Therefore, it is intended that the scope of the present disclosure includes all embodiments falling within the spirit and scope of the appended claims.

| [Description of Main Elements] | |
|---|---|
| 10: nanowires | 20: coating material |
| 30: solvent | 40: nanowire solution |
| 100: transparent substrate | 200: heat-emitting layer |
| 300: electrode terminal layer | |

What is claimed is:

1. A transparent film heater comprising:

a transparent substrate; and a heat-emitting layer that comprises conductive nanowires, and a coating material applied to the nanowires and functioning to bind the nanowires with each other, is disposed on the transparent substrate, and emits heat upon the application of a voltage, wherein the coating material comprises at least one of indium tin oxide (ITO) or aluminum zinc oxide (AZO).

2. The transparent film heater according to claim 1, wherein the transparent substrate has flexibility.

3. The transparent film heater according to claim 1, wherein the transparent substrate is a substrate having a light transmission of at least 80%.

4. The transparent film heater according to claim 1, wherein the nanowires are silver (Ag) nanowires.

5. The transparent film heater according to claim 1, which further comprises an electrode terminal layer disposed at either side edge of the heat-emitting layer.

6. The transparent film heater according to claim 1, wherein the transparent substrate is disposed on a display panel, periscope, defroster or goggle.

7. A method for manufacturing a transparent film heater, comprising the steps of:

(A) mixing conductive nanowires with a solvent to provide a nanowire solution;

(B) applying the nanowire solution to a transparent substrate; and (C) applying a coating material to the nanowires applied to the transparent substrate to form a heat-emitting layer that emits heat upon the application of a voltage, wherein the coating material comprises at least one of indium tin oxide (ITO) and aluminum zinc oxide (AZO).

8. The method for manufacturing a transparent film heater according to claim 7, wherein the transparent substrate has flexibility.

9. The method for manufacturing a transparent film heater according to claim 7, wherein the transparent substrate is a substrate having a light transmission of at least 80%.

10. The method for manufacturing a transparent film heater according to claim 7, wherein the nanowires are silver (Ag) nanowires.

11. The method for manufacturing a transparent film heater according to claim 7, which further comprises a step of additionally applying the nanowire solution at least once, after the step of applying the nanowire solution.

12. The method for manufacturing a transparent film heater according to claim 11, which further comprises, after the step of additionally applying the nanowire solution, a step of heat treating the additionally applied nanowire solution.

13. The method for manufacturing a transparent film heater according to claim 7, which further comprises a step of disposing an electrode terminal layer for applying the voltage at either side of the heat-emitting layer, after the step of forming the heat-emitting layer.

* * * * *